US011779066B2

(12) United States Patent
Markoglou et al.

(10) Patent No.: US 11,779,066 B2
(45) Date of Patent: Oct. 10, 2023

(54) GOWN

(71) Applicant: Medicom Group Inc., Pointe-Claire (CA)

(72) Inventors: Nektaria Markoglou, Montreal (CA); Xin Hua Li, Montreal (CA)

(73) Assignee: MEDICOM GROUP INC., Pointe-Claire (CA)

( * ) Notice: Subject to any disclaimer, the term of this patent is extended or adjusted under 35 U.S.C. 154(b) by 374 days.

(21) Appl. No.: 17/004,483

(22) Filed: Aug. 27, 2020

(65) Prior Publication Data

US 2021/0106084 A1 Apr. 15, 2021

Related U.S. Application Data

(60) Provisional application No. 62/915,237, filed on Oct. 15, 2019.

(51) Int. Cl.
*A41D 13/12* (2006.01)

(52) U.S. Cl.
CPC ..... *A41D 13/1236* (2013.01)

(58) Field of Classification Search
CPC .. A41B 3/02; A41D 13/1209; A41D 13/1236; A41D 13/1245; A41D 13/129
See application file for complete search history.

(56) References Cited

U.S. PATENT DOCUMENTS

| | | | | |
|---|---|---|---|---|
| 3,397,406 | A * | 8/1968 | Leach | A41F 1/00 2/96 |
| 3,464,063 | A * | 9/1969 | Hoegerman | A41D 13/1236 2/114 |
| 3,977,025 | A * | 8/1976 | Horan | A41D 13/1209 206/440 |
| 4,000,521 | A * | 1/1977 | Zoephel | A41D 13/1209 2/114 |
| 5,414,867 | A * | 5/1995 | Bowling | A41D 13/1209 2/46 |
| 6,378,136 | B2 * | 4/2002 | Matsushita | A41D 13/1209 2/114 |
| D687,209 | S | 8/2013 | Levine | |
| 8,701,215 | B2 * | 4/2014 | Levine | A41D 13/12 2/114 |
| D721,870 | S | 2/2015 | Levine | |
| 10,064,440 | B2 | 9/2018 | Levine | |

(Continued)

FOREIGN PATENT DOCUMENTS

| | | |
|---|---|---|
| EM | 20201373.6-1005 | 3/2021 |
| GB | 2016312.7 | 3/2021 |

(Continued)

*Primary Examiner* — Sally Haden
(74) *Attorney, Agent, or Firm* — Rothwell, Figg, Ernst & Manbeck, P.C.

(57) ABSTRACT

A gown is disclosed with an opening in the back extending from the neck area to the bottom creating 2 panels. At least one elastic/flexible/stretchable strap is provided in the neck area of the gown. Each flexible strap has one end attached to each of the 2 panels of the open gown. The gown is designed for the first panel to extend over the second panel and can be weighted to minimize any movement of the first panel away from the second panel. In another embodiment a portion of the first panel extends to the user's side or front area and secured to the side or front of the gown.

10 Claims, 6 Drawing Sheets

(56) References Cited

U.S. PATENT DOCUMENTS

| | | | | |
|---|---|---|---|---|
| 2005/0132463 | A1* | 6/2005 | Kathumbi-Jackson | A41D 13/1209 2/51 |
| 2005/0132465 | A1* | 6/2005 | Kathumbi-Jackson | A41D 13/1209 2/114 |
| 2013/0036526 | A1* | 2/2013 | Rashman | A41D 13/1245 2/114 |
| 2016/0316823 | A1* | 11/2016 | Licenziato Monti | A44B 3/00 |
| 2019/0343198 | A1* | 11/2019 | Palomo | A41D 13/129 |

FOREIGN PATENT DOCUMENTS

| | | | |
|---|---|---|---|
| JP | 2004238773 | A | 8/2004 |
| WO | 2014/123223 | A1 | 8/2014 |

* cited by examiner

GOWN

CROSS-REFERENCE TO RELATED APPLICATION

The present application claims priority to U.S. Provisional Patent Applications Ser. No. 62/915,237 filed Oct. 15, 2019 which is hereby incorporated herein by reference in entirety for all purposes.

BACKGROUND

Many types of gowns used in medical procedures by patients, visitors, and medical personnel exist. Both disposable and reusable gowns are utilized. It is important for gowns to be put on easily (donning) and removed (doffing) while ensuring compliance and limiting cross contamination by the user. Securing the gown so that it does not fall off is critical. Various means are used such as ties, belts, buttons, hooks and loops, and snaps. Current gowns use a waist tie or belt that require the user to either tie the belt behind their back or reach around their back to tie the belt. As a result, improper gown use is common because many users have difficulty passing the belt around their backs or reaching behind their back to tie it. In addition, dependent on procedures that the medical professionals need to perform ties in the front can interfere in workflows (example ties touching sterile supplies in sterile area being prepared by medical professional to treat patient) Many users also neglect to tie their gowns properly when faced with an urgent situation or addressing multiple patients. In many situations medical personnel cannot have anything on the front of the gown including the joining of straps securing the gown.

SUMMARY

A gown which can be pulled over the user's head and then secured without the user needing to reach behind themselves to their back. The back of the gown is opened from the neck area of the gown to the bottom of the gown creating 2 panels.

At least one elastic/flexible/stretchable strap is provided in the neck area of the gown. Each flexible strap has one end attached to each of the 2 panels of the open gown. The gown is designed for the first panel to extend over the second panel and can be weighted to minimize any movement of the first panel away from the second panel. In another embodiment a portion of the first panel extends to the user's side or front area and secured to the side or front of the gown.

DETAILED DESCRIPTION

Figure 1:
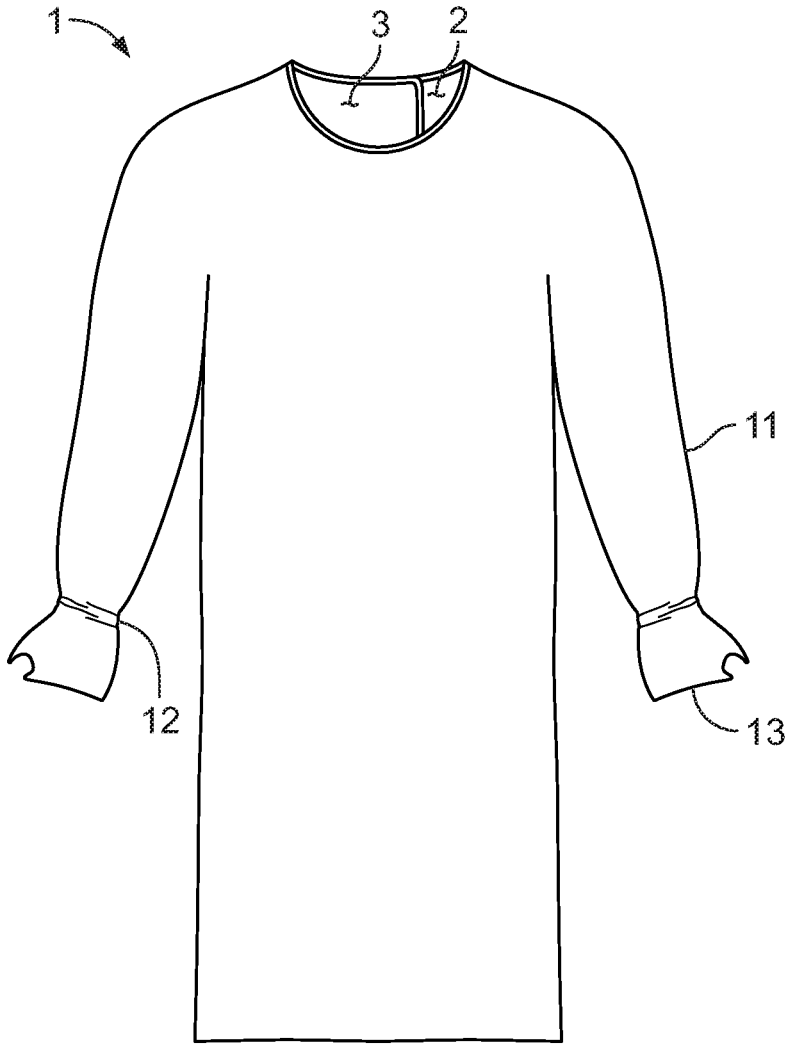
FIG. 1 depicts a front view of the gown.
Figure 2:
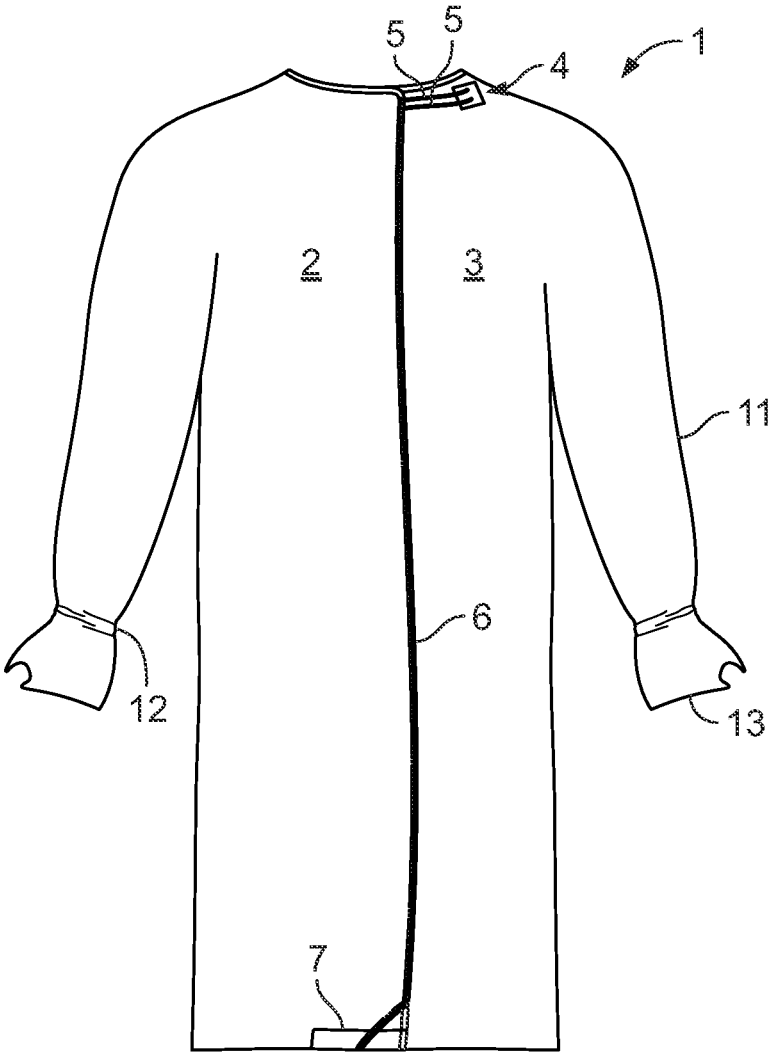
FIG. 2 depicts a rear view of the gown.
Figure 3:
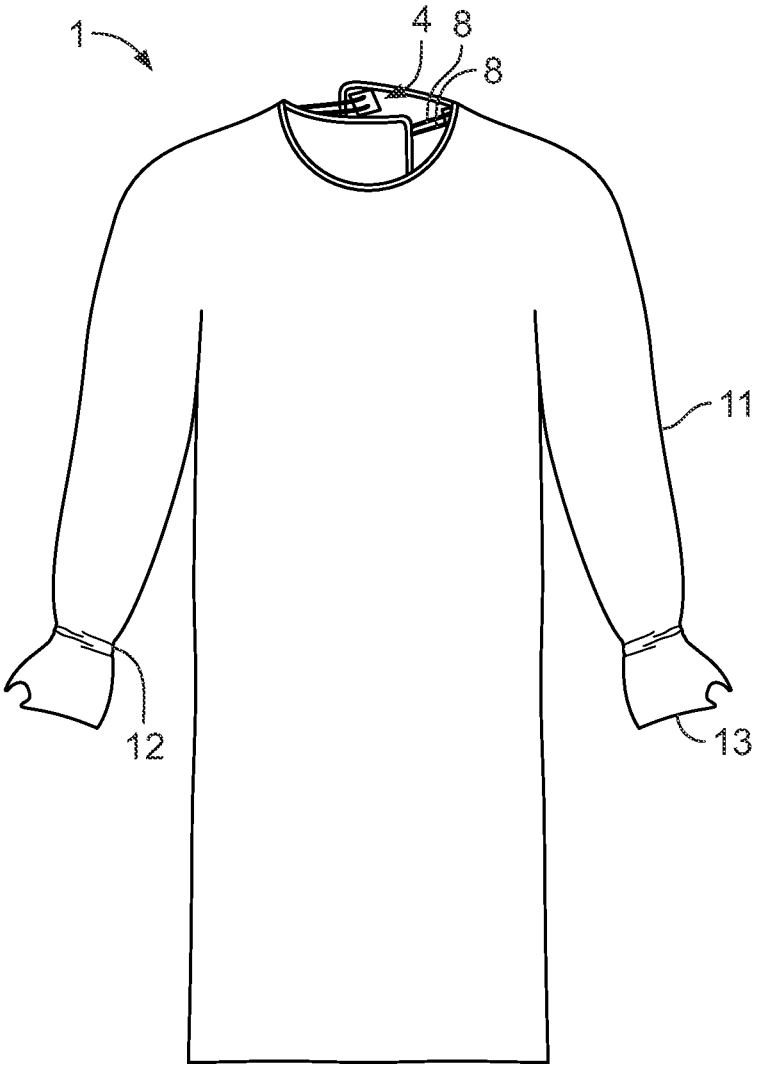
FIG. 3 depicts a rear view of another embodiment of the gown with 2 straps.
Figure 4:
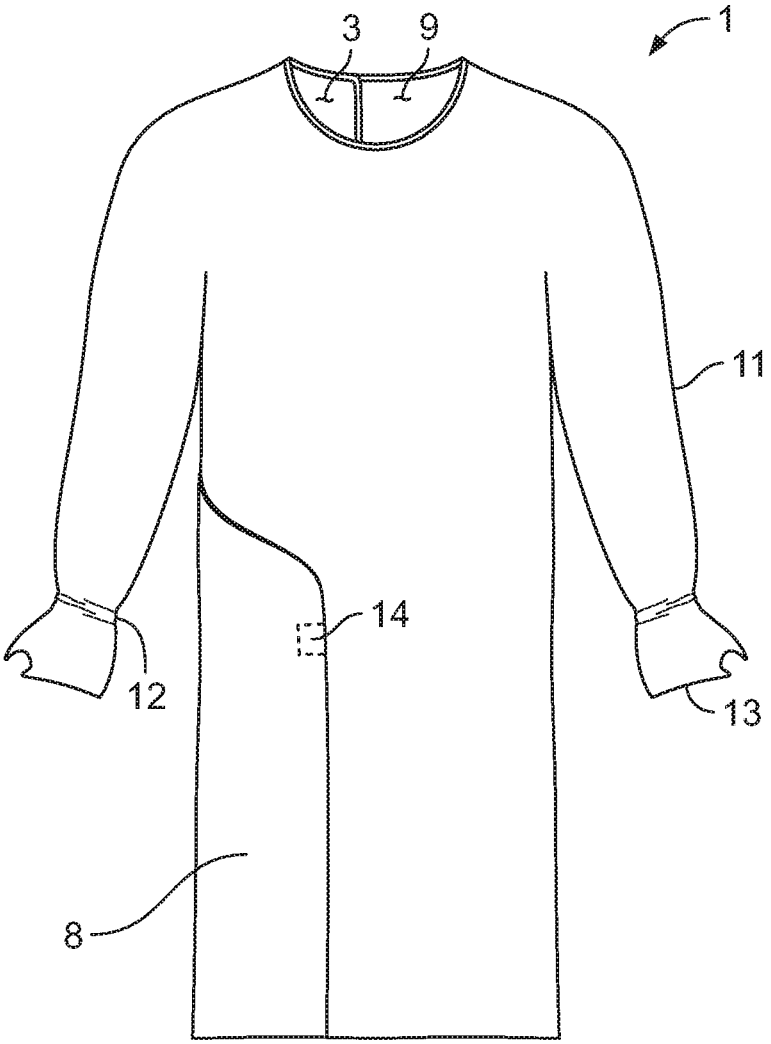
FIG. 4 depicts a front view of another embodiment of the gown.

Disclosed is a gown (1) with the back open from the top of the gown to the bottom creating two panels in the back of the gown. (FIGS. 1-6) The first panel (2) is created to overlap a portion of the second panel (3) for the entire length of the second panel. At least one elastic/flexible/stretchable strap (4) is provided in the neck area of the gown. FIGS. 4 & 6 depict gowns with 2 straps (4 & 8). Each strap (4 & 8) has two ends with one end attached to each of the 2 panels allowing the neck area to be opened more for a user to pull the gown down over the user's head. Each strap (4) can have one or more elastic strip (5) between the 2 ends of the strap (4).

The flexible straps (4) are positioned to be in the neck/shoulder area of the user to prevent the gown from falling off the user and allows for the gown to stretch and adjust to the movements and requirements of users of different sizes. The material of the gown can be varied as warranted by the intended use and the intended user. The gown can be disposable or reusable.

In one embodiment the first panel (2) which is designed to overlap the second panel (3) has additional weight (6 or 7) on the portion of that panel which extends beyond the second panel (3). The weight (6 or 7) is designed to assist in keeping the first panel (2) in place overlapping the second panel (3). In other embodiments weight (6 or 7) can be added on both panels. The weight (6 or 7) can be at the bottom (7) of one or both panels or can be on the entire length (6) of the panels. One way to incorporate an additional weight in the first panel is to have it overlap back onto itself (6) for a portion of the first panel. In other embodiments a weight device (7) is attached to the first panel in the bottom area. The weight is selected to be consistent with the gown design considering the gown material, whether it is disposable or not, and other factors which are chosen by the gown manufacturer.

In another embodiment at least a portion of the first panel (9) extends to the side or front of the gown and may be designed to be fastened by the user to the front or side of the gown without having to reach behind the user. Numerous means can be selected by anyone skilled in the gown field to securely fasten/attach (14) the portion of first panel (9) to the side or front of the gown such as the use of hook and loop, pressure sensitive adhesive strips, or snaps attached to the first panel and with compatible snaps on the side or front of the gown.

Figure 5:
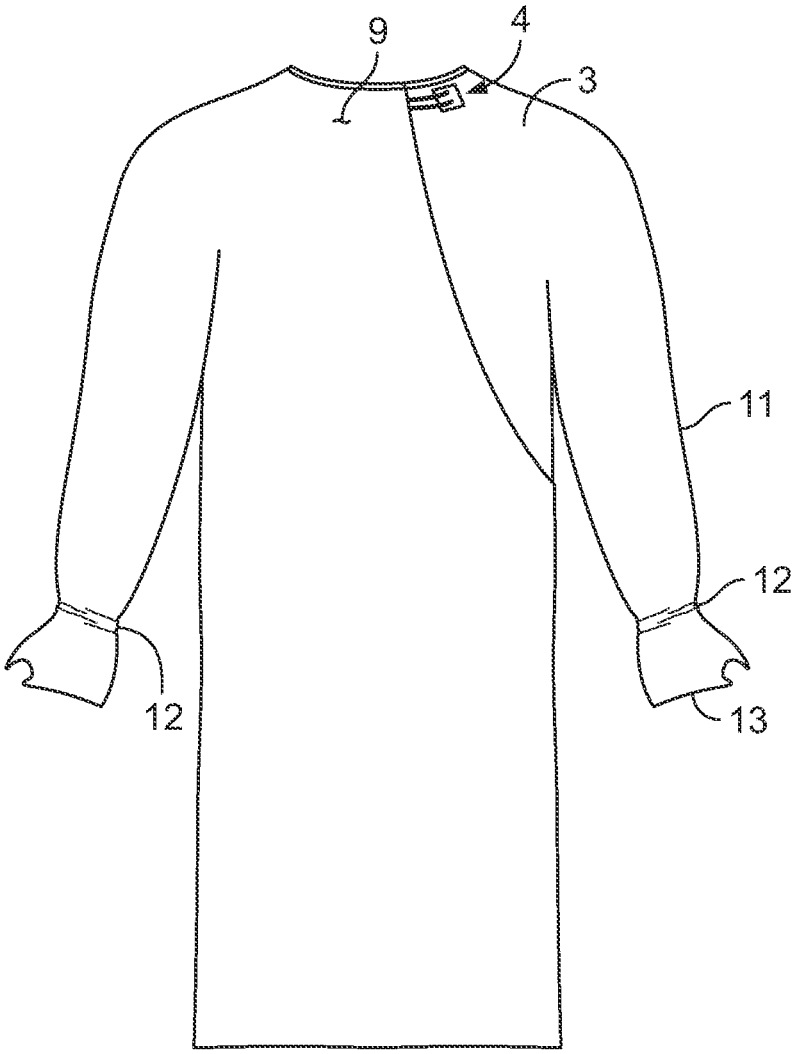
FIG. 5 depicts a front view of another embodiment of the gown.
Figure 6:
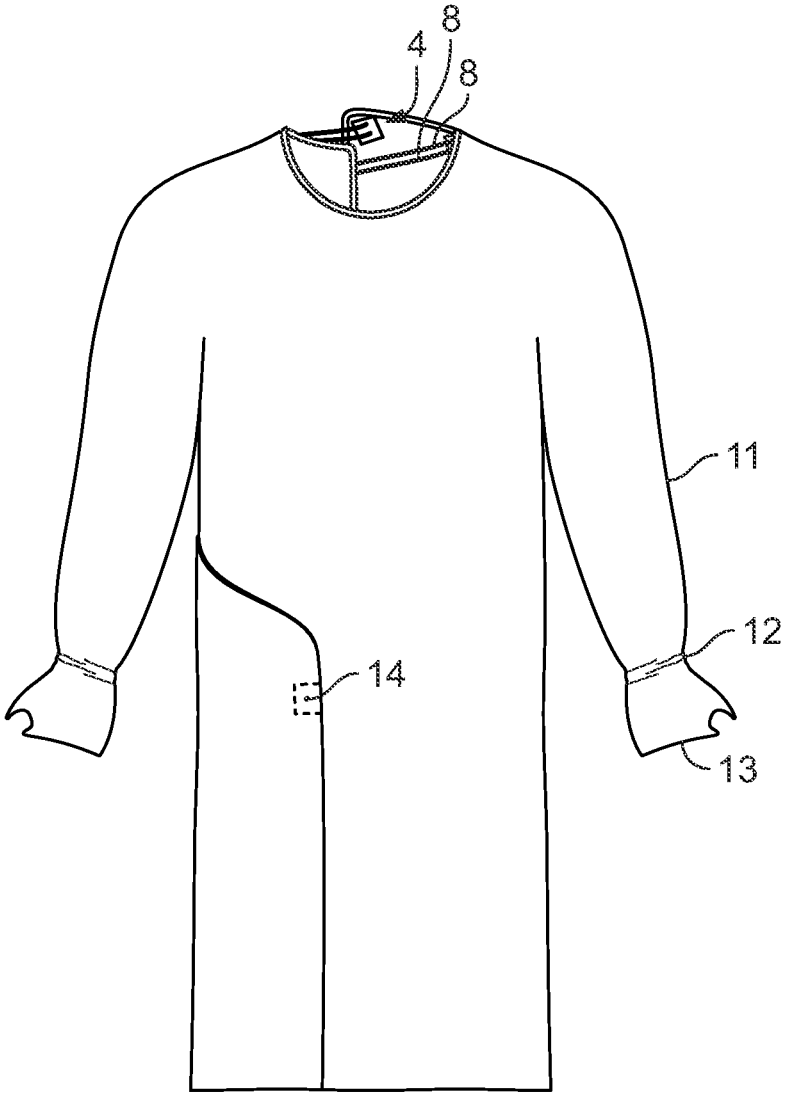
FIG. 6 depicts a front view of another embodiment of the gown with 2 straps.

To limit contamination in another embodiment shown on FIGS. 4-6 only a portion of the first panel (9) extends over the second panel (3). The location and amount of the portion of the first panel (9) created to overlap the second panel (3) can be chosen based on the intended use of the gown. In example shown on FIGS. 4-6 the first panel (9) extends over the second panel (3) for the bottom the gown up to an area intended to be at or above the waist of the intended user of the gown. In addition, the first panel (9) can extend over the second panel (3) in the top/neck area of the gown. In this embodiment the first panel (9) may include a securing mechanism (10) designed to be fastened by the user to the front or side of the gown without having to reach behind the user.

The gown can include sleeves (11) with or without openings for the for the user's hands. The sleeves extend out from the body covering portion down to each hand. Separate openings for the thumb and other fingers (11) can be provided and will also function as an additional means to secure the gown to the user. The cuff (12) at the hand can be elastic to further secure the gown in place. This is especially important when the user is for example a surgeon.

Disclosed is a gown including: a body covering portion with an opening in a back of the gown from a top neck area of the gown to a bottom area of the gown creating a first panel and a second panel. A portion of the first panel is designed to extend over the second panel; and at least one elastic strap with two ends which is the neck area on the gown has one end of each elastic strap attached to the first panel and a second end of each elastic strap attached to the second panel. The disclosed gown can include 2 or even more straps as designed for a particular application.

The gown can include a weight added to the first panel especially in a section extending over the second panel. The gown may be designed with only a section of the portion of the first panel designed to extend over the second panel extending over the second panel. The section of the portion of the first panel designed to extend over the second panel may extend from a bottom area of the gown to at least a waist area of the gown.

All embodiments can be incorporated into disposable or reusable gowns. The gowns can be designed for use by numerous users including for example surgeons, patients, personnel in other applications besides medical such as food preparation, chemical testing and industrial clean rooms.

The above is a detailed description of some embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All embodiments disclosed and claimed herein can be made and executed without undue experimentation in light of the present disclosure.

The invention claimed is:

1. A gown comprising:

a body covering portion with an opening in a back of the gown from a top neck area of the gown to a bottom area of the gown creating a first panel and a second panel, wherein a portion of the first panel extends over the second panel;

a first elastic strap comprising first and second ends, wherein, in a neck area on the gown, the first end of the first elastic strap is attached to the portion of the first panel that extends over the second panel, and the second end of the first elastic strap is attached to a portion of the second panel over which the portion of the first panel does not extend; and a second elastic strap comprising first and second ends, wherein, in the neck area of the gown, the first end of the second elastic strap is attached to a portion of the first panel that does not extend over the second panel, and the second end of the second elastic strap is attached to a portion of the second panel over which the portion of the first panel extends.

2. The gown according to claim 1, wherein the first panel of the gown comprises a weight.

3. The gown according to claim 1, further comprising sleeves extending out from the body of the gown to an area configured for a hand of a user.

4. The gown according to claim 3, further comprising separate openings in the sleeve for a thumb and for other fingers.

5. The gown according to claim 1, wherein the first panel extends to a front or a side of the gown and is configured to be fastened by a user to the front or the side of the gown.

6. The gown according to claim 1, wherein only a section of the portion of the first panel that extends over the second panel extends over the second panel to a front or a side of the gown.

7. The gown according to claim 6, wherein the section of the portion of the first panel that extends over the second panel extends from a bottom area of the gown to at least a waist area of the gown.

8. The gown according to claim 1, wherein the gown is disposable.

9. The gown according to claim 1, wherein the gown is configured to be reusable.

10. The gown according to claim 1, wherein the first elastic strap further comprises at least two elastic strips between the first and second ends of the first elastic strap, and the second elastic strap further comprises at least two elastic strips between the first and second ends of the second elastic strap.

* * * * *